US007229303B2

(12) United States Patent
Vermoesen et al.

(10) Patent No.: US 7,229,303 B2
(45) Date of Patent: Jun. 12, 2007

(54) ENVIRONMENTALLY SEALED CONNECTOR WITH BLIND MATING CAPABILITY

(75) Inventors: Michel J. Vermoesen, Miamisburg, OH (US); William C. Kruckemeyer, Beavercreek, OH (US); Robert A. Neal, Dayton, OH (US); Kathleen Murphy, Wilmington, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/302,063

(22) Filed: Dec. 13, 2005

(65) Prior Publication Data

US 2006/0172576 A1 Aug. 3, 2006

Related U.S. Application Data

(60) Provisional application No. 60/648,224, filed on Jan. 28, 2005.

(51) Int. Cl.
*H01R 13/52* (2006.01)

(52) U.S. Cl. ..... 439/271; 439/587; 439/281; 439/282; 439/732

(58) Field of Classification Search ..... 439/271, 439/281, 282, 732, 587
See application file for complete search history.

(56) References Cited

U.S. PATENT DOCUMENTS 2,958,845 A 11/1960 Dupre et al.

(Continued)

FOREIGN PATENT DOCUMENTS

DE 30 24 038 10/1981

(Continued)

OTHER PUBLICATIONS

European Search Report dated May 23, 2006.

(Continued)

*Primary Examiner*—Tho D. Ta
(74) *Attorney, Agent, or Firm*—Scott A. McBain

(57) ABSTRACT

A connector assembly (10) is provided including a first connector (12) and a second connector (14) configured to mateably engage the first connector (12). The first connector (12) includes a housing (16), a conductor assembly (18) positioned within the housing and projecting from housing, and a resilient seal member (30) enclosing an interface between the housing (16) and the portion of the conductor assembly projecting from the housing. The second connector (14) includes an outer contact (60), an inner contact (62) nested within a portion of the outer contact (60), and a housing (64) containing the inner and outer contacts. Conductors of the conductor assembly (18) of the first connector (12) engage the outer (60) and inner (62) contacts of the second connector (14). Another resilient seal member (45) includes a flexible skirt (50) formed at an end portion thereof. The flexible skirt (50) forms a shroud covering a mating interface between a first conductor (20) of the first connector (12) and the inner contact (62) of the second connector (14) when the first and second connectors are mated. Design features incorporated into the second connector housing (64), inner contact (62), and outer contact (60) act to retard undesirable unmating of the connectors. The connector assembly (10) of the present invention may be used in applications requiring a dual wire or coaxial connector resistant to adverse environmental conditions, such as exposure to high-pressure gases or liquids, elevated temperatures, vibration, salt spray, etc.

10 Claims, 5 Drawing Sheets

U.S. PATENT DOCUMENTS

| | | | | | |
|---|---|---|---|---|---|
| 3,206,540 | A | | 9/1965 | Cohen | |
| 3,449,706 | A | * | 6/1969 | Carissimi | 439/141 |
| 3,471,824 | A | * | 10/1969 | Greulich et al. | 439/282 |
| 3,582,862 | A | | 6/1971 | Anderson | |
| 3,854,789 | A | | 12/1974 | Kaplan | |
| 4,417,736 | A | * | 11/1983 | Herrmann, Jr. | 439/559 |
| 4,521,064 | A | | 6/1985 | Knapp et al. | 439/153 |
| 4,648,672 | A | | 3/1987 | Kobler | 439/271 |
| 4,697,861 | A | | 10/1987 | Mitchell | 439/271 |
| 4,698,027 | A | * | 10/1987 | Vandame | 439/271 |
| 4,698,028 | A | | 10/1987 | Caro et al. | 439/271 |
| 4,702,710 | A | * | 10/1987 | Dittman et al. | 439/271 |
| 4,940,421 | A | | 7/1990 | Kano et al. | 439/273 |
| 5,011,432 | A | | 4/1991 | Sucht et al. | |
| 5,295,864 | A | | 3/1994 | Birch et al. | 439/578 |
| 5,498,175 | A | | 3/1996 | Yeh et al. | |
| 6,139,349 | A | * | 10/2000 | Wright | 439/271 |
| 6,402,538 | B2 | * | 6/2002 | Suzuki | 439/271 |
| 6,641,421 | B1 | * | 11/2003 | Leavitt et al. | 439/271 |
| 6,769,926 | B1 | | 8/2004 | Montena | |
| 2004/0038586 | A1 | | 2/2004 | Hall et al. | |
| 2005/0181652 | A1 | | 8/2005 | Montena et al. | 439/271 |

FOREIGN PATENT DOCUMENTS

| | | |
|---|---|---|
| FR | 2 507 394 | 12/1982 |
| WO | 00/14829 | 3/2000 |

OTHER PUBLICATIONS

European Search Report dated Aug. 22, 2006.

* cited by examiner

ENVIRONMENTALLY SEALED CONNECTOR WITH BLIND MATING CAPABILITY

CROSS REFERENCE TO RELATED APPLICATIONS

This application claims the benefit of provisional application Ser. No. 60/648,224, filed on Jan. 28, 2005.

BACKGROUND OF THE INVENTION

The present invention relates to electrical connectors and, more particularly, to electrical connectors designed for blind mating and for use in adverse environmental conditions.

In some connector applications, blind mating of connectors (i.e., mating with no visual feedback provided to a user during mating) is necessary. Problems encountered with connectors under conditions of blind mating primarily involve centering and alignment of the connectors for proper mating of the electrical contacts without damage to the contacts. Additional mating problems, specific to each type of connector, may also arise. For example, in the blind mating of coaxial connectors, the center conductor of the coaxial cable should possess sufficient rigidity to resist the insertion forces encountered during mating without buckling.

Problems caused by the need for blind mating capability may be compounded when the connector must be designed to operate in adverse environmental conditions, for example, in high-pressure environments and/or in environments with a risk of exposure to excess moisture or contaminants. In such cases, one or more seals must usually be provided to prevent or minimize exposure of the contact interface to the adverse conditions or contaminants. In addition, in some applications, engagement between mating contacts should be permanent to ensure proper functioning of the connector. Thus, the contact interface may be required to provide at least a specified minimum normal force to ensure proper operation of the connector and to inhibit undesired disengagement of the mated electrical contacts. Finally, it may be necessary to secure each contact within the connector housing or mounting structure in a manner sufficient to ensure that at least a minimum desired retention force (or pull-out force) is required to forcibly remove the contact from the housing.

SUMMARY OF THE INVENTION

In accordance with the present invention, a connector assembly is provided including a first connector and a second connector configured to mateably engage the first connector. The first connector includes a housing, a conductor assembly positioned within the housing and projecting from housing, and a resilient seal member enclosing an interface between the housing and the portion of the conductor assembly projecting from the housing. The second connector includes an outer contact, an inner contact nested within a portion of the outer contact, and a housing containing the inner and outer contacts. Portions of the conductor assembly of the first connector engage the outer and inner contacts of the second connector. Another resilient seal member includes a flexible skirt formed at an end portion thereof. The flexible skirt forms a shroud covering a mating interface between a first conductor of the first connector and the inner contact of the second connector when the first and second connectors are mated. Design features incorporated into the second connector housing, inner contact, and outer contact act to impede undesirable unmating of the connectors. The connector assembly of the present invention may be used in applications requiring a dual wire or coaxial connector resistant to adverse environmental conditions, such as exposure to high-pressure gases or liquids, elevated temperatures, vibration, salt spray, etc.

BRIEF DESCRIPTION OF THE DRAWINGS

In the drawings illustrating embodiments of the present invention.

DETAILED DESCRIPTION

Figure 1:
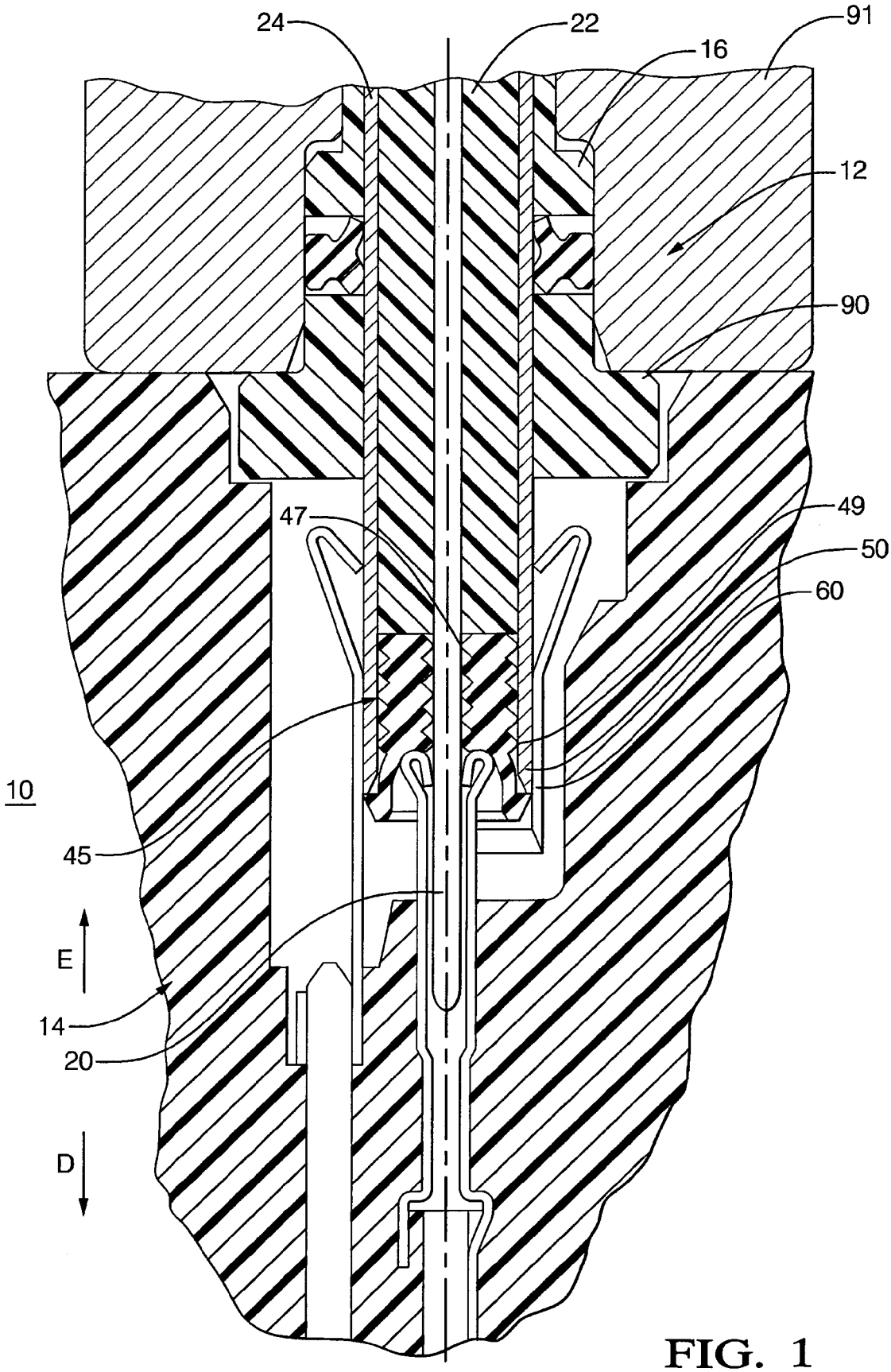
FIG. 1 is a cross-sectional side view of one embodiment of a mated connector assembly in accordance with the present invention.

FIG. 1 shows a connector assembly 10 constructed in accordance with the present invention. Connector assembly 10 includes a first connector 12 and a second connector 14 configured to mateably engage first connector 12.

Figure 2:
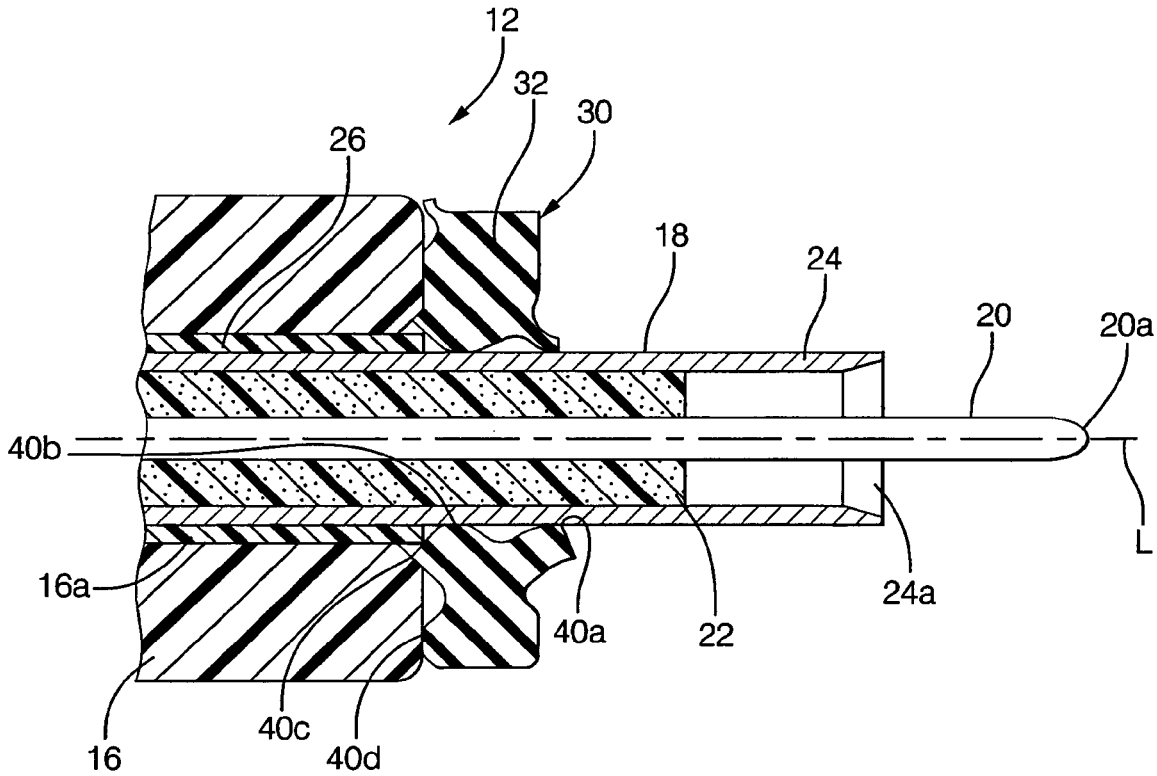
FIG. 2 is a partial cross-sectional side view of a mating end of one embodiment of a first connector in accordance with the present invention.

Referring to FIG. 2, first connector 12 includes a housing 16, a conductor assembly 18 positioned within housing 16 and projecting from housing 16, and a seal member 30 enclosing the interface between housing 16 and the portion of conductor assembly 18 projecting from the housing. Conductor assembly 18 projects through an orifice 16*a* formed in housing 16. Housing 16 is shaped to provide surfaces for manipulation by a user or by an automated assembly device, for purposes of mating the first connector 12 with second connector 14. Housing 16 is also shaped to provide surfaces that aid in locating and centering first connector 12 with respect to second connector 14 during mating of the connector assembly. In addition, housing 16 also aids in protecting conductor assembly 18 from damage. Housing 16 may be formed from any rigid polymer material resistant to hydrocarbon-based fluids, such as polyvinyl chloride (PVC) or glass-filled nylon. Housing 16 may be fabricated by known methods (for example, by molding) after which conductor assembly 18 is positioned and secured within housing 16 using known methods, for example adhesives or interference fits. Alternatively, housing 16 may be overmolded onto conductor assembly 18.

Figure 3:
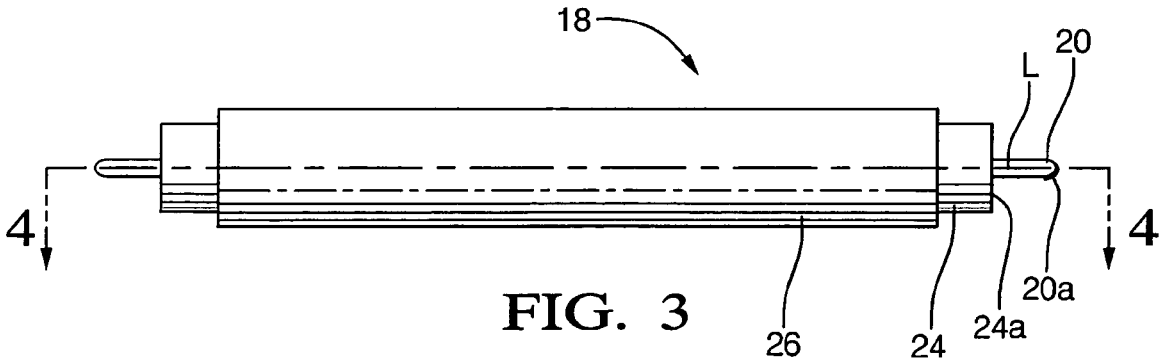
FIG. 3 is a side view of a conductor assembly in accordance with the present invention.
Figure 4:
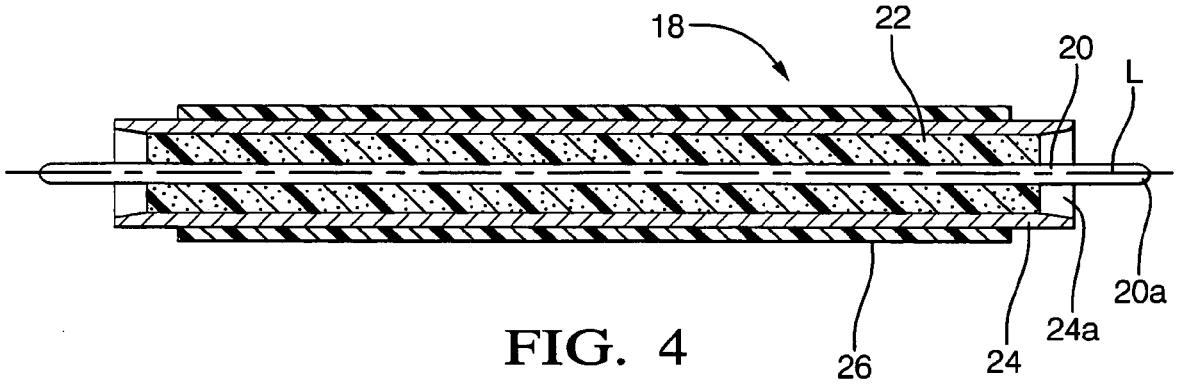
FIG. 4 is a cross-sectional view of the conductor assembly shown in FIG. 3.

Referring to FIGS. 3 and 4, conductor assembly 18 includes a center conductor 20 and a center insulator or dielectric material 22 enclosing center conductor 20. An end portion of center conductor 20 projects from a corresponding end portion of center dielectric 22. An outer conductor 24 encloses center dielectric 22 and center conductor 20, and an outer insulator or dielectric material 26 encloses outer conductor 24. An end portion of outer conductor 24 projects from a corresponding end portion of outer dielectric 26.

In the embodiment shown in the drawings, center conductor 20 terminates in a tapered or rounded end portion 20*a* that aids in locating and centering center conductor 20 with respect to second connector 14 during mating of the connector assembly. Center conductor 20 is a substantially cylindrical solid conductor having a relatively rigid structure configured to resist buckling and lateral deformation during mating of the connector assembly. Center conductor 20 may be formed from a wire comprising a conductive metal or metal alloy, for example cartridge brass, beryllium copper, or copper covered steel. A centerline L extending along a centroidal axis of center conductor 20 defines a mating axis of first connector 12.

Center dielectric 22 separates center conductor 20 from outer conductor 24. Also, as seen in FIGS. 1 and 2, an end portion of center dielectric 22 is recessed from an end portion of outer conductor 24 such that the center dielectric end portion abuts an insulator plug 45 (described below) positioned in an end portion of outer conductor 24, within the recess. Center dielectric 22 may be formed from a polymer material having a dielectric constant within a desired predetermined range, depending on the connector application. Suitable materials for center dielectric 22 include various types of glass-filled nylon, polyethylene, polyurethane, and Teflon®.

Outer conductor 24 aids in shielding center conductor 20 from spurious electromagnetic interference. Outer conductor 24 also aids in protecting center conductor 20 from physical damage. Outer conductor 24 includes an opening 24*a* which is beveled to ease insertion of an insulator plug 34 (described in greater detail below) therein during assembly of first connector 12. Outer conductor 24 may be formed as a tube or sleeve from a conductive metal or metal alloy, for example cartridge brass, beryllium copper, or copper covered steel.

Outer dielectric 26 aids in protecting conductors 20 and 24 from damage. Outer dielectric 26 may be overmolded or otherwise suitably applied to an outer surface of outer conductor 24. Outer dielectric 26 may comprise a polymer material such as polyvinyl chloride (PVC). Other suitable materials for outer dielectric include various types of glass-filled nylon, polyethylene, polyurethane, and Teflon®.

Referring again to FIG. 2, seal member 30 encloses and protects the interface between housing 16 and the portion of conductor assembly 18 projecting from the housing, thereby preventing flow of undesirable contaminants along conductor assembly 18 between outer dielectric 26 and housing 16. An environmental seal is provided by one or more annular lips extending from external surfaces of seal member 30. In the embodiment shown in FIG. 2, seal member 30 includes multiple lips 40*a*–40*d*. Lips 40*a* and 40*b* provide bearing surfaces compressively engaging outer conductor 24, and lips 40*c* and 40*d* provide bearing surfaces compressively engaging one or more external surfaces of housing 16. Multiple lips 40*a*–40*d* also aid in distributing compressive loads on seal member 30 resulting from fluid pressure on the seal member. Seal member 30 may be formed from a moldable polymer material having elastomeric characteristics and resistance to hydrocarbon-based fluids and other fluids. Examples of suitable types of materials are thermoplastic polyester elastomers and high-temperature polyurethanes. One specific, non-exclusive example of a suitable material is Hytrel® thermoplastic polyester manufactured by DuPont®.

Figure 5:
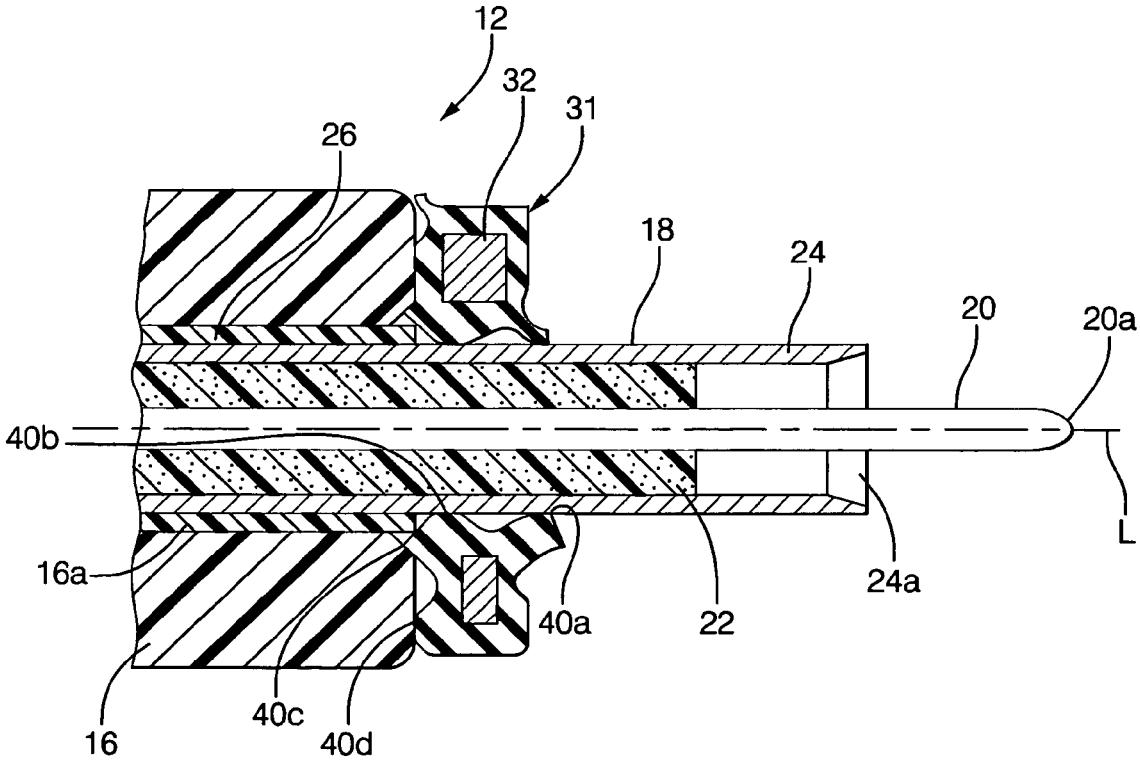
FIG. 5 is a partial cross-sectional side view of a mating end of an alternative embodiment of a first connector in accordance with the present invention.

In FIG. 5, like numerals are used to identify features similar to those identified in FIG. 2. Referring to FIG. 5, in an alternative embodiment, a seal member 31 incorporates a reinforcing member 32 for structurally reinforcing against loads experienced by seal member 31. Reinforcing member 32 may be overmolded into seal member 31, or the insert may be bonded to or otherwise placed into engagement with one or more surfaces of seal member 31. Reinforcing member 32 may be formed from, for example, a suitable metal or polymer material.

Figure 6:
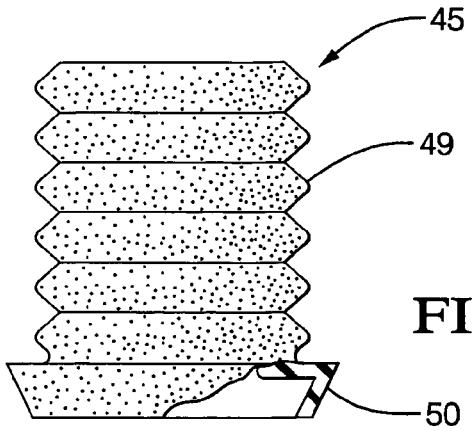
FIG. 6 is a partial cross-sectional side view of an insulator plug in accordance with the present invention.

Referring to FIGS. 1 and 6, an annular insulator plug 45 is positioned around center conductor 20 proximate center dielectric 22. Insulator plug 45 is generally cylindrical, with an inner surface formed into a first plurality of accordion folds 47 and an outer surface formed into a second plurality of accordion folds 49. Accordion folds 47 engage an outer surface of center conductor 20 in a plurality of interference fits. In addition, accordion folds 49 engage an inner surface of outer conductor 24 in a plurality of interference fits. These interference fits aid in positioning and retaining plug 45 on first connector 12 during handling of first connector 12 and during mating of first connector 12 to second connector 14. In addition, the interference fits prevent migration of contaminants along the annular passage extending between center conductor 20 and outer conductor 24.

In a manner described in greater detail below, an end portion of insulator plug 45 forms a flexible skirt 50 which stretches to extend around a portion of second connector 14 during and after mating of connectors 12 and 14, thereby forming a seal around the contact interface when the connectors are mated.

Plug 45 may be formed from a moldable polymer material having elastomeric characteristics and resistance to hydrocarbon-based fluids and other fluids. Examples of suitable types of materials are thermoplastic polyester elastomers and high-temperature polyurethanes. One specific, non-exclusive example of a suitable material is Hytrel® thermoplastic polyester manufactured by DuPont®.

Figure 7:
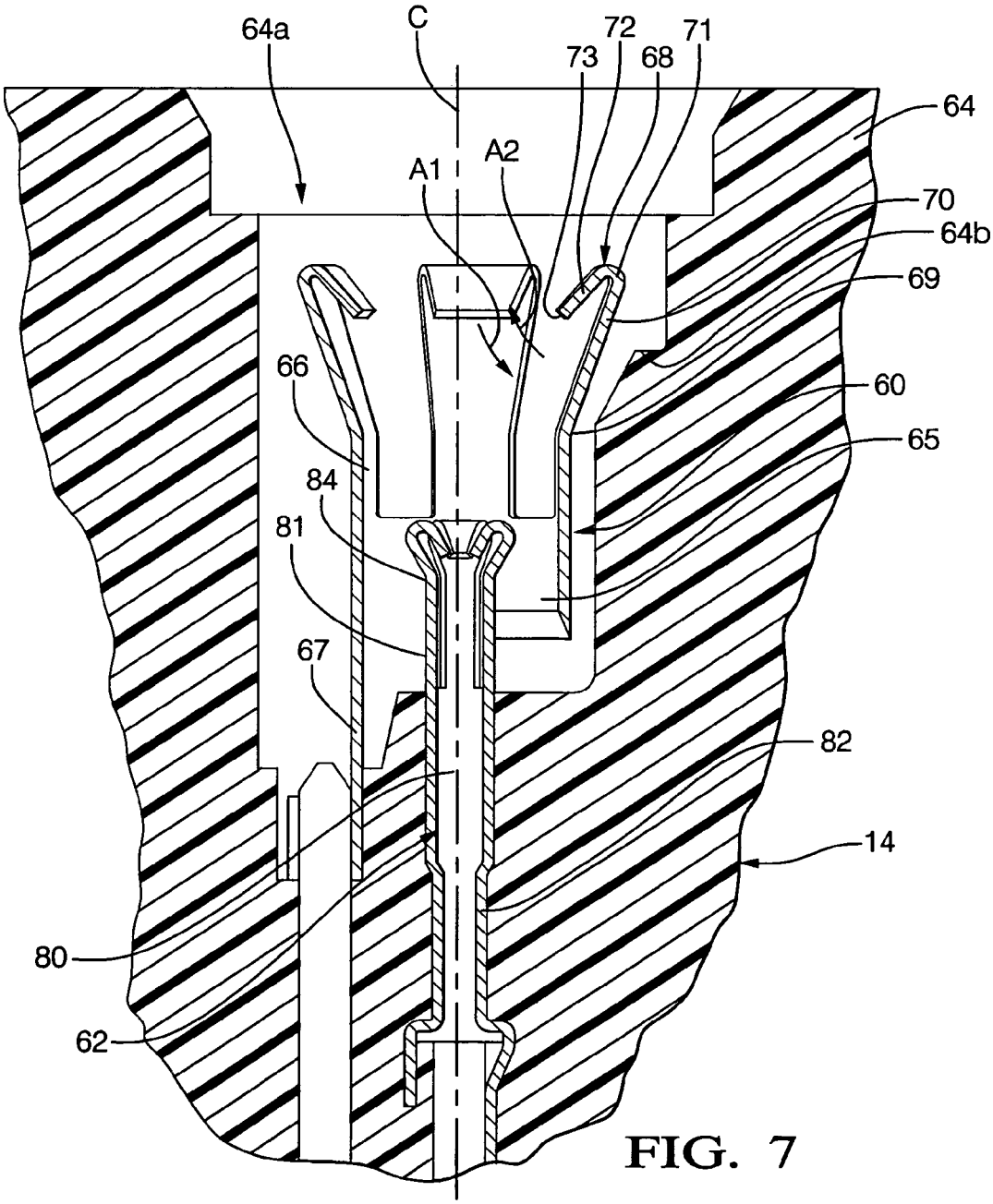
FIG. 7 is a partial cross-sectional side view of a mating end of a second connector in accordance with the present invention.
Figure 8:
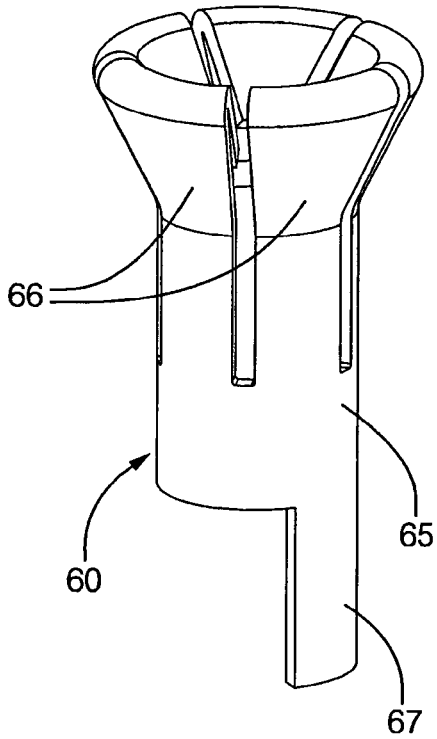
FIG. 8 is a perspective view of an outer contact incorporated into the second connector shown in FIG. 7.

Referring to FIGS. 1, 7 and 8, second connector 14 includes an outer contact 60, an inner contact 62 nested within a portion of the outer contact, and a housing 64 containing the inner and outer contacts. Referring to FIGS. 7 and 8, outer contact 60 includes a substantially cylindrical barrel portion 65 and a plurality of cantilevered blade portions 66 extending from the barrel portion in a first direction. A tail portion 67 extends from barrel portion 65 in a second direction generally opposite the first direction in which blade portions 66 extend. Tail portion 67 may be electrically connected to a conductive element, such as a wire or another terminal (not shown) using methods known in the art, such as soldering or resistance welding. A centerline C extending through the center of barrel portion 65 defines a mating axis of second connector 14. FIG. 8 shows a perspective view of the embodiment of outer contact 60 seen in FIG. 7.

Each of blade portions 66 includes a formed end portion 68 having a first bend 69, a first blade segment 70 flaring generally radially outwardly, a second bend 71 extending from blade first segment 70, and a contact segment 72 extending from second bend 71. As used herein with reference to second connector inner contact 62 and outer contact 60, the term "bend" refers to any curved section of a contact, whether stamped or stamped and formed. Contact segments 72 are configured to project generally radially inwardly at an angle with respect to second connector mating axis C to form lead-ins for outer conductor 24 of first connector 12 during mating of the connector assembly. These lead-in features aid in locating and positioning first connector 12 with respect to second connector 14 during blind mating of the connectors. In addition, each contact segment 72 is configured with respect to its associated first blade segment 70 such that the contact segment is resiliently deformable with respect to the first segment 70, along the directions indicated by arrows A1 and A2. In this respect, contact segments 72 act as cantilever beam members having fixed ends extending from respective ones of second bends 71. Each of contact segments 72 has a die break 73 provided along a radially innermost edge portion of the contact segment. Die breaks 73 serve as contact surfaces by which outer contact 60 engages an outer surface of outer conductor 24 of first connector 12 during mating. The provision of multiple flexible blade portions 66 and the provision of a die break 73 along each of flexible blade portions 66 help to ensure multiple, redundant contact points and sufficient normal force between outer conductor 24 and outer contact 60 under adverse environmental conditions (for example, during vibration of the connector assembly and/or in environments subject to extreme temperature variations.) Outer contact 60 is stamped and formed using known methods from sheet or strip of conductive metal or metal alloy, for example cartridge brass, beryllium copper, or copper covered steel.

Figure 9:
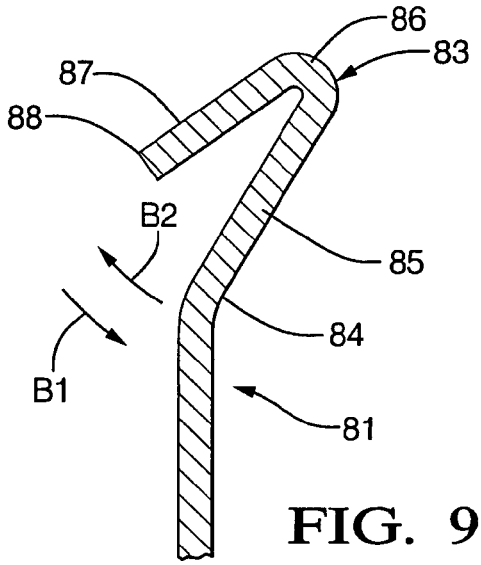
FIG. 9 is a detail view of a portion of an inner contact incorporated into the second connector shown in FIG. 7.

Referring to FIGS. 7 and 9, inner contact 62 includes a substantially cylindrical barrel portion 80 and a plurality of cantilevered blade portions 81 extending from the barrel portion in a first direction. A tail portion 82 extends from barrel portion 80 in a second direction generally opposite the first direction in which blade portions 81 extend. Tail portion 82 may be electrically connected to a conductive element, such as a wire or another terminal (not shown) using methods known in the art, such as soldering or resistance welding. A centerline extending through the center of inner contact barrel portion 80 is coaxial with centerline C of outer contact 60 defining a mating axis of second connector 14.

Referring to FIGS. 7 and 9, each of blade portions 81 includes a formed end portion 83 having a first bend 84, a first blade segment 85 flaring generally radially outwardly, a second bend 86 extending from first blade segment 85, and a contact segment 87 extending from second bend 86. Contact segments 87 are configured to project generally radially inwardly at an angle with respect to second connector mating axis C to form lead-ins for center conductor 20 of first connector 12 during mating of the connector assembly. These lead-in features aid in locating and positioning first connector 12 with respect to second connector 14 during blind mating of the connectors. In addition, each contact segment 87 is configured with respect to its associated first blade segment 85 such that the contact segment is resiliently deformable with respect to the first segment 85, along the directions indicated by arrows B1 and B2. In this respect, contact segments 87 act as cantilever beam members having fixed ends extending from respective ones of bends 86. Each of contact segments 87 has a die break 88 provided along a radially innermost edge portion of the contact segment. Die breaks 88 serve as contact surfaces by which inner contact 62 engages an outer surface of inner conductor 20 of first connector 12 during mating. The provision of multiple flexible blade portions 81 and the provision of a die break 88 along each of flexible blade portions 81 help to ensure multiple, redundant contact points and sufficient normal force between inner conductor 20 and inner contact 62 under adverse environmental conditions (for example, during vibration of the connector assembly and/or in environments subject to extreme temperature variations.) Inner contact 62 is stamped and formed using known methods from sheet or strip of conductive metal or metal alloy, for example cartridge brass, beryllium copper, or copper covered steel.

Referring to FIG. 7, second connector housing 64 maintains a desired spatial relationship between inner contact 62 and outer contact 60. Housing 64 is also shaped to provide surfaces for manipulation by a user or by an automated assembly device, for purposes of mating the first connector 12 with second connector 14. Housing 64 is also shaped to provide surfaces that aid in locating and centering first connector 12 with respect to second connector 14 during mating of the connector assembly. In addition, housing 64 also aids in protecting inner contact 62 and outer contact 60 from damage.

In the embodiment shown in FIG. 7, inner contact 62 and outer contact 60 reside within a cavity 64*a* formed in housing 64 and shaped to receive portions of conductor assembly 18 and/or first connector housing 16 therein during mating of the connector assembly, in a manner described in greater detail below. In addition, an annular shoulder 64*b* extends along an inner wall of interior cavity 64*a*, for purposes described in greater detail below.

Housing 64 may be formed from any rigid polymer material resistant to hydrocarbon-based fluids, such as polyvinyl chloride (PVC) or glass-filled nylon. Housing 64 may be fabricated by known methods (for example, by molding), after which the components of second connector 14 are positioned and secured within housing 64 using known methods, for example adhesives or interference fits. Alternatively, inner terminal 62 may be fixtured with respect to outer terminal 60, and housing 64 may then be overmolded onto the fixtured components of second connector 14.

Referring to FIG. 1, the mating portion of first connector 12 is assembled by mounting seal member 30 onto conductor assembly 18 abutting housing 16. A sleeve 90 is then slidingly fitted onto an outer surface of conductor assembly 18 such that seal member 30 is compressed between housing 16 and sleeve 90. Housing 16, seal member 30, and a portion of sleeve 90 are positioned within a cavity formed in a piston rod 91 adapted for mounting these elements of first connector 12 therein. Seal member 30 is thus resiliently compressed between housing 16, sleeve 90, and a wall of the cavity in piston rod 91, thereby forming a seal along the wall of the cavity.

Figure 11:
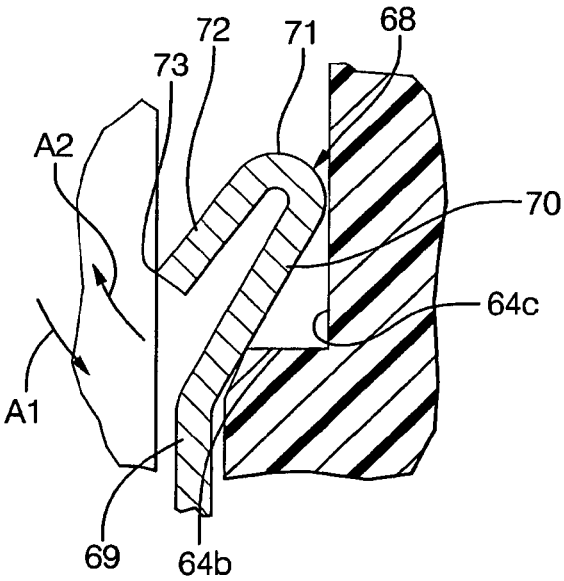
FIG. 11 is a detail view of a portion of an outer contact incorporated into the second connector shown in FIG. 7.

Mating of connectors 12 and 14 will now be discussed with reference to FIGS. 1, 10, and 11.

Figure 10:
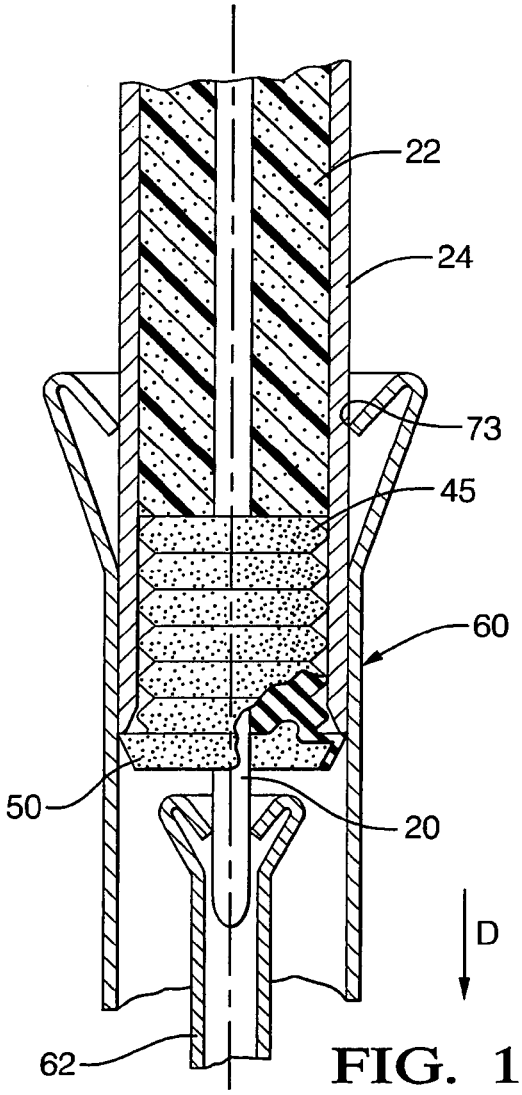
FIG. 10 is a partial cross-sectional side view of the connector assembly of FIG. 1, showing a stage of assembly prior to the assembly stage shown in FIG. 1.

FIGS. 1 and 10 show different stages in the mating of connectors 12 and 14. Referring to FIGS. 1 and 10, when it is desired to mate first connector 12 with second connector 14, the portion of conductor assembly 18 extending from first connector housing 16 is inserted into second connector housing cavity 64*a*, in the direction indicated by arrow D. The complementary shapes of first and second connector housings 16 and 64 aid in locating the connectors with respect to each other. Also, the complementary shapes of first and second connector housings 16, 64 and the lead-in structures provided by outer contact 60 and inner contact 62 of second connector 14 aid in centering outer conductor 24 with respect to outer contact 60, and also aid in centering inner conductor 20 with respect to inner contact 62. As first connector 12 is inserted into second connector 14 in the direction indicated by arrow D, die break 73 (FIG. 7) formed along outer contact 60 engages an outer surface of outer conductor 24. Similarly, die break 88 (FIG. 9) formed along inner contact 62 engages an outer surface of inner conductor 20.

Referring to FIG. 9, as contact segment 87 of inner contact 62 is rotatable in the directions indicated by arrows B1 and B2, contact segment 87 is able to deflect inward in direction B1 during insertion of center conductor 20 into contact 62, thereby reducing the insertion force needed for mating the connectors. Similarly, referring to FIG. 7, as contact segment 72 of outer contact 60 is rotatable in the directions indicated by arrows A1 and A2, contact segment 72 is able to deflect inward in direction A1 during insertion of outer conductor 24 into contact 60, thereby reducing the insertion force needed for mating the connectors.

Referring again to FIGS. 1, 7, and 9, as first connector 12 is inserted more deeply into second connector housing cavity 64*a*, bend 86 of inner contact 62 impinges on insulator plug 45, tending to axially compress plug 45 in the direction indicated by arrow E (FIG. 1). Continued motion of first connector 12 in direction D forces plug flexible skirt 50 to expand in direction D, thereby forming a shroud over the ends of inner contact blade portions 81. Referring to FIG. 1, in this configuration, skirt 50 insulates and separates inner contact 62 from outer contact 60 during mating of the connectors. Skirt 50 also insulates and separates inner contact 62 from outer conductor 24 of first connector 12.

FIG. 1 shows engagement between inner conductor 20 and inner contact 62, and between outer conductor 24 and outer contact 60 when the connectors are in their mated configuration. Connectors 12 and 14 are designed to be permanently mated. That is, the connectors are not intended to be unmated once they have been mated. The design of outer contact 60 and inner contact 62 are configured to maximize the force required to withdraw first connector 12 from second connector 14, to aid in preventing unmating of the connectors. Referring to FIGS. 1 and 11, if a withdrawal force is exerted on first connector 12 in direction E (and/or a is force exerted on second connector 14 in direction D), engagement between outer contact die-break 73 and outer conductor 24 acts to resist withdrawal of outer conductor 24 from second connector 14. Similarly, engagement between inner contact die-break 88 and inner conductor 20 acts to resist withdrawal of inner conductor 20 from second connector 14. If the withdrawal force on first connector 12 is increased, outer contact die-break will tend to remain engaged with outer conductor 24, forcing contact segment 72 of outer contact 60 to rotate in the direction indicated by arrow A2, and also forcing first segment 70 to rotate about first bend 69 in the direction indicated by arrow A2. Continued rotation of blade first segment 70 in direction A2 causes first segment 70 to abut second connector housing shoulder 64*b*, thereby preventing further rotation of first segment 70 about first bend 69. In addition, referring to FIG. 11, an inner wall 64*c* of second connector housing cavity tends to restrict movement of the blade end portions of outer contact 60 by limiting rotation of first segment 70 about bend 69. Thus, continued rotation of blade first segment 70 also causes second bend 71 to abut inner wall 64*c*, thereby preventing further rotation of first segment 70 about bend 69.

Referring to FIG. 9, in a similar manner, inner contact die-break 88 will tend to remain engaged with inner conductor 20, forcing contact segment 87 (FIG. 9) of inner contact 62 to rotate in the direction indicated by arrow B2, and also forcing inner contact first segment 85 to rotate about first bend 84 in the direction indicated by arrow B2. Also, referring to FIGS. 1 and 9, flexible skirt 50 of insulator 45 tends to limit both rotation of contact segment 87 and rotation of first segment 85 due to withdrawal of inner conductor 20 from inner contact 62.

The sum effect of the interactions described above (between inner contact 62 and inner conductor 20 and also between outer contact 60, outer conductor 24, and second connector housing 64) is to resist unmating of first connector 12 from second connector 14. When blade end portions 68 abut portions of second connector housing 64 and blade end portions 83 abut insulator 45 as described above, attempts to further withdraw outer conductor 24 and inner conductor 20 from second connector 14 may result in plastic deformation of blade end portions 68 and 83, permanently damaging outer contact 60 and inner contact 62.

It should be understood that the preceding is merely a detailed description of various embodiments of this invention and that numerous changes to the disclosed embodiments can be made in accordance with the disclosure herein without departing from the spirit or scope of the invention. The preceding description, therefore, is not meant to limit the scope of the invention.

What is claimed is:

1. A connector comprising:

a conductor assembly including a first conductor, a second conductor spaced apart from the first conductor and enclosing at least a portion of the first conductor, and a first resilient seal member interposed between the first conductor and the second conductor, the first seal member having a plurality of first accordion folds engaging at least a portion of the first conductor to form a corresponding plurality of interference fits with the first conductor, and a plurality of second accordion folds engaging at least a portion of the second conductor to form a corresponding plurality of interference fits with the second conductor.

2. The connector of claim 1 wherein the first seal member is formed from an elastomeric material.

3. The connector of claim 1 wherein the first seal member includes a flexible skirt formed at an end portion thereof, for forming a shroud covering a mating interface between the first conductor and a complementary mating conductor when the first conductor is mated with the mating conductor.

4. The connector of claim 3 wherein a portion of the mating conductor engages a portion of the shroud during attempted unmating of the first conductor from the mating conductor, to impede unmating of the first conductor from the mating conductor.

5. The connector of claim 1 wherein the conductor assembly further includes an insulator positioned exterior of the second conductor and enclosing at least a portion of the second conductor, and wherein the connector further comprises a second resilient seal member including a plurality of lips engaging at least a portion of the second conductor along a surface thereof, to impede migration of contaminants therealong.

6. The connector of claim 5 wherein the second seal member is formed from an elastomeric material.

7. The connector of claim 5 further comprising a first connector housing, and wherein the conductor assembly is secured within the housing and extends from the housing, and the second seal member further includes a plurality of lips engaging the housing along at least one surface thereof to impede migration of contaminants to an interface between the housing and the insulator.

8. The connector of claim 5 further comprising another insulator interposed between the first and second conductors, the other insulator having an end portion abutting the first seal member for positioning the first seal member along the first conductor.

9. The connector of claim 5 wherein a reinforcing member engages the second seal member for structurally reinforcing the second seal member.

10. The connector of claim 9 wherein the reinforcing member is insert-molded within the second seal member.

* * * * *